US006533280B1

(12) United States Patent
Sovine et al.

(10) Patent No.: US 6,533,280 B1
(45) Date of Patent: Mar. 18, 2003

(54) BULLET BACKSTOP ASSEMBLY

(76) Inventors: H. Addison Sovine, P.O. Box 636, Provo, UT (US) 84603-0636; Kyle Bateman, P.O. Box 636, Provo, UT (US) 84603-0636

( * ) Notice: Subject to any disclaimer, the term of this patent is extended or adjusted under 35 U.S.C. 154(b) by 0 days.

(21) Appl. No.: 09/519,058

(22) Filed: Mar. 3, 2000

(51) Int. Cl.[7] ..... F41J 1/12

(52) U.S. Cl. ..... 273/410; 52/93.1; 52/79.5; 52/650.2

(58) Field of Search ..... 273/404, 410, 273/405, 407; 89/36.06, 36.07; 52/223.11, 79.5, 93.1, 93.2, 282.2, 650.2, 651.06, 651.09, 90.1

(56) References Cited

U.S. PATENT DOCUMENTS

| | | | |
|---|---|---|---|
| 385,546 | A | 7/1888 | Decumbus |
| 694,581 | A | 3/1902 | Reichlin |
| 840,610 | A | 1/1907 | Easdale |
| 941,642 | A | 11/1909 | Maxim |
| 2,013,133 | A | 9/1935 | Caswell |
| 2,411,026 | A | 11/1946 | Conner et al. |
| 2,420,304 | A | 5/1947 | Diem |
| 2,518,445 | A | 8/1950 | Benson |
| 2,631,454 | A | 3/1953 | Shepard et al. |
| 2,772,092 | A | 11/1956 | Nikoden |
| 3,404,887 | A | 10/1968 | Dundr |
| 3,447,806 | A | 6/1969 | Pfaff et al. |
| 3,701,532 | A | 10/1972 | Nikoden |
| 3,737,165 | A | 6/1973 | Pencyla |
| 3,982,761 | A | 9/1976 | DeVogelaere |
| 4,126,311 | A | 11/1978 | Wagoner |
| 4,294,452 | A | 10/1981 | Schlotter et al. |
| 4,317,572 | A | 3/1982 | Iseli |
| 4,445,693 | A | 5/1984 | Angwin |
| 4,458,901 | A | 7/1984 | Wojcinski |
| 4,728,109 | A | 3/1988 | Simonetti |
| 4,786,059 | A | 11/1988 | Barini |
| 4,787,289 | A | 11/1988 | Duer |
| 4,819,946 | A | 4/1989 | Kahler |
| 4,821,620 | A | 4/1989 | Cartee et al. |
| 4,846,043 | A | 7/1989 | Langsam |
| 4,919,437 | A | 4/1990 | Salabe et al. |
| 5,040,802 | A | 8/1991 | Wojcinski et al. |
| 5,070,763 | A | 12/1991 | Coburn |
| 5,085,765 | A | 2/1992 | Salabé et al. |
| 5,113,700 | A | 5/1992 | Coburn |
| 5,121,671 | A | 6/1992 | Coburn |
| D329,680 | S | 9/1992 | Burn |
| 5,171,020 | A | 12/1992 | Wojcinski |
| 5,255,024 | A | 10/1993 | Copius |
| 5,340,117 | A | 8/1994 | Wojcinski |
| 5,400,692 | A | 3/1995 | Bateman |
| 5,405,673 | A | 4/1995 | Seibert |

(List continued on next page.)

FOREIGN PATENT DOCUMENTS

| | | | |
|---|---|---|---|
| WO | 94/27111 | * | 11/1999 |

OTHER PUBLICATIONS

Super Trap Bullet Containment Systems, Super Trap, ST Bullet Containment Systems, Inc.
The Porta Target Catalog.
Caswell Catalog.
Duel Atron Target Systems Catalog.

*Primary Examiner*—Mark S. Graham
(74) *Attorney, Agent, or Firm*—Morriss, Bateman, O'Bryant & Compagni

(57) ABSTRACT

A bullet backstop assembly includes a modular support structure formed from legs, vertical ribs and horizontal ribs, and a modular inclined surface formed from a plurality of back panels. The back panels and the components of the support structure are attached to one another to form a bullet backstop assembly which may be assembled and disassembled without welding and with minimal use of tools.

24 Claims, 10 Drawing Sheets

U.S. PATENT DOCUMENTS 5,435,571 A 7/1995 Wojcinski et al.
5,441,280 A 8/1995 Copius
5,535,662 A 7/1996 Bateman
5,564,712 A 10/1996 Werner
5,592,789 A * 1/1997 Liddell, Sr. et al. ..... 52/93.1
5,607,163 A 3/1997 Nesler
5,655,775 A * 8/1997 Pontus et al. ..... 273/410
5,811,718 A 9/1998 Bateman
5,822,936 A 10/1998 Bateman
5,848,794 A 12/1998 Wojcinski et al.
5,901,960 A * 5/1999 Nesler et al. ..... 273/410
6,000,700 A * 12/1999 Nesler et al. ..... 273/410
6,173,956 B1 * 1/2001 O'Neal ..... 273/410

* cited by examiner

BULLET BACKSTOP ASSEMBLY

BACKGROUND OF THE INVENTION

1. Field of the Invention

The present invention relates to a system configured for decelerating bullets and other projectiles. More particularly, the present invention relates to a low-cost system which provides improved flexibility in the formation of the bullet backstop.

2. State of the Art

It is common for law enforcement officers and others to routinely engage in target practice in order to maintain their proficiency in use of their firearms. Target practice was traditionally conducted in settings where preventing ricochets was the primary concern, and recovery of bullets was secondary. Firing ranges commonly used a large mound of earth to decelerate the bullet after it had passed through the target. Such systems were generally safe, in that the dirt was effective in stopping the bullets, shot, etc., and thus preventing injuries.

More recently, however, considerable concern has been raised about the lead contained in the bullets. Though the bullet fired into the mound of dirt was safely contained from the point of being a moving projectile with a significant amount of inertial momentum, the lead in the bullet was free to escape into the environment. Thus, the more recent trend in shooting ranges has also stressed containment and recycling of the bullet to prevent environmental damage.

The current trend in bullet containment has focused on two different types of systems. One kind of containment system, often called a bullet stop and containment chamber, has a pair of plates which channel bullets toward an opening in a containment chamber. Inside the containment chamber are impact plates to slow the bullet to a stop. (As used herein, bullet may include bullets, shot and other forms of projectiles).

Bullet stop and containment chambers are highly advantageous because the entire deceleration process is controlled by sheets of steel plate. When formed properly, such a system can withstand hundreds of thousands, if not millions, of rounds without showing excessive wear.

Unfortunately, bullet stop and containment systems which use steel plate containment chambers are also relatively expensive. Numerous sheets of the steel must be welded together to form the chambers. Transportation of the chambers and final construction of the systems can add considerably to the cost.

Due to these difficulties, there has also been a significant increase in the number of lower-end bullet backstops. Bullet backstops typically include a back wall plate made of steel. The back wall plate is usually disposed transverse to the ground at an angle between about 30–40 degrees. A plurality of support legs extend downwardly from the underside of the back wall plate to the ground.

On an upper side of the wall, a berm of impact material is disposed to provide a medium for decelerating bullets. The impact material in berm bullet traps has traditionally been dirt or sand. However, over the last decade there has been a trend toward the use of pieces of rubber to decelerate the bullets. As a bullet impacts the pieces of rubber, it decelerates sufficiently that if the bullet does impact the back wall plate, any ricocheting will be minimal.

To ensure that the back wall plate is adequately supported, the legs are usually welded to the back wall plate and may be welded to interconnecting structures which extend between the legs. While providing adequate support, such a configuration has two major disadvantages. First, because the legs must be welded to the plate sections which form the back wall plate, the legs must be attached either prior to shipping, thereby increasing shipping expenses due to size, or must be attached in the field, adding to set-up time and cost.

If the legs are attached to the plate sections prior to shipping, shipping costs are generally greater and it is often difficult to get the plate sections and legs through the doors of an indoor shooting range. Because many traps are placed in existing buildings, pre-attaching the legs can make installation extremely difficult.

Attaching the legs in the field is also problematic. As noted above, attaching the legs consumes a significant amount of time. Many installers are employees of the company manufacturing the trap. Thus, the employees are often on per diem and excessive time installing the backstop assembly can add significantly to the cost.

In addition to the added time and cost, having the legs welded to the back wall plate also renders the backstop virtually unmovable. In the event that the backstop must be moved, many of the welded parts must be cut off. Cutting the legs from the back stop is a laborious task and complicates reinstalling the backstop at a later time or in a different location.

Thus, there is a need for a bullet backstop assembly which can be quickly and easily assembled with little or no welding. Such a bullet backstop assembly may also be disassembled with little inconvenience. Additionally, such a bullet backstop assembly should be relatively inexpensive.

SUMMARY OF THE INVENTION

It is an object of the present invention to provide a bullet backstop assembly which can be assembled with little or no welding.

It is another object of the present invention to provide such a bullet backstop assembly which can be assembled in less time than conventional systems.

It is another object of the present invention to provide such a bullet backstop assembly which can be disassembled without cutting portions of the backstop assembly.

It is still another object of the present invention to provide such a bullet backstop assembly which is relatively inexpensive and easy to install.

The above and other objects of the invention are realized in a bullet backstop assembly which includes an inclined surface configured for holding a layer of bullet decelerating medium, such as pieces of rubber or sand, and a support structure which is positioned under the inclined surface to hold the inclined surface at a desired angle.

The support structure includes a plurality of legs which are interconnected by a plurality of generally vertical ribs and generally horizontal ribs. The legs and the ribs are preferably attached to one another without welding and may be released from one another with minimal effort.

In accordance with one aspect of the invention, the inclined surface is formed from a plurality of plates assembled together to form a back wall plate. The plates are releasably attached to the ribs of the support structure to form the inclined surface and to enable rapid assembly and disassembly of the trap. With the plates attached to the support structure, the plates form an inclined surface for receiving the projectile deceleration material—typically granules of rubber.

In accordance with another aspect of the present invention, one or more berm fins are attached to the inclined surface. The berm fins support the bullet deceleration material to keep the material from sliding down the inclined surface. As with the support structure, the berm fins are preferably removably attached to the back wall plate defining the inclined surface.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims. Furthermore, it should be appreciated that the components of the individual embodiments discussed may be selectively combined in accordance with the teachings of the present disclosure.

Figure 1:
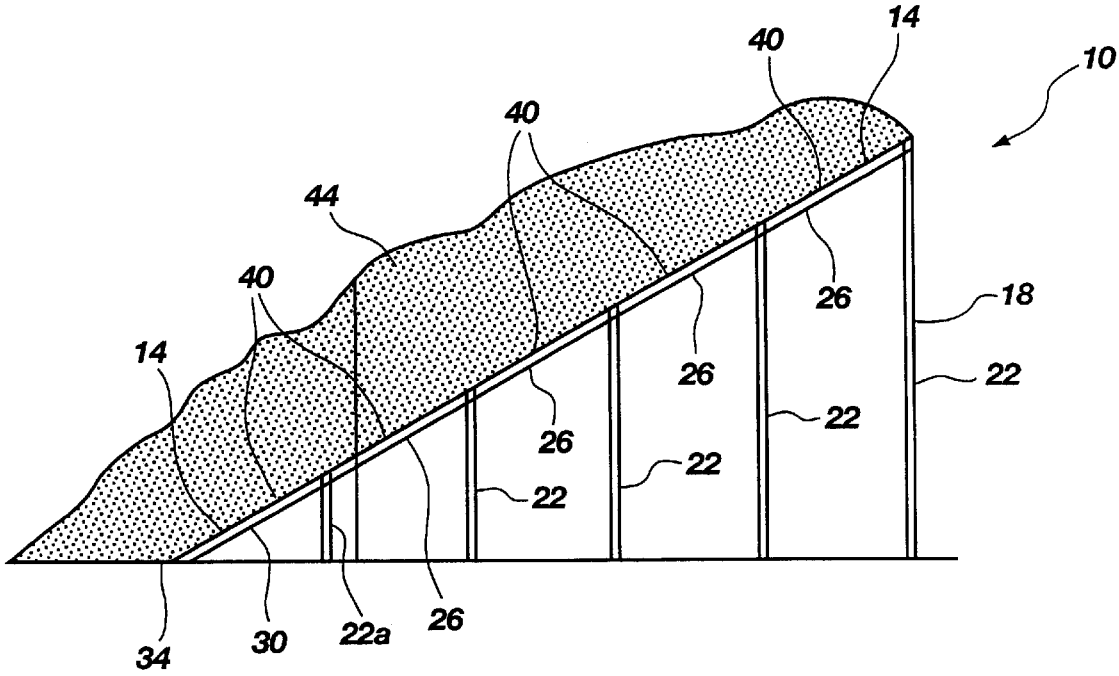
FIG. 1 shows a side view of a bullet backstop assembly made in accordance with the principles of the present invention.

Referring to FIG. 1, there is shown a side view of a bullet backstop assembly, generally indicated at 10, made in accordance with the teachings of the present invention. The bullet backstop assembly 10 includes an inclined surface 14 which is formed by a back wall plate made of steel or some other extremely durable material.

The inclined surface 14 is preferably disposed at an angle of between about 30 and 40 degrees. While the inclined surface may be disposed at nearly any angle between zero and 90 degrees, disposing the backstop between about 30 and 40 degrees minimizes the amount of material required to decelerate projectiles while minimizing the space consumed by the assembly.

Extending downwardly from the inclined surface 14 is a support structure 18 which includes a plurality of legs 22. The legs 22 are interconnected by a plurality of vertical ribs 26 and horizontal ribs (not shown in FIG. 1). A vertical floor rib 30 extends downwardly from the smallest leg 22*a* to the floor 34 to provide continuous support to the back wall plate forming the inclined surface 14.

Disposed on the top of the inclined surface 14, opposite the support structure 18, is a plurality of berm fins 40. The berm fins 40 are spaced along the inclined surface 14 to help retain a bullet deceleration medium 44, such as shredded rubber, on the inclined surface. Typically, the pieces of rubber will be piled about 2 feet deep on the inclined surface so that a bullet traveling horizontally has to pass through between 4 and 5 feet of the deceleration medium before contacting the back wall plate which forms the inclined surface 14.

As bullets are fired into the deceleration medium 44, it is the natural tendency for the medium to flow downhill. After significant use, the deceleration material 44 will thin out near the top and increase the likelihood of a projectile impacting the material forming the inclined surface 14. The berm fins 40 substantially slow the downward flow of the deceleration medium 44, but are sufficiently small that they do no pose a ricochet danger. If a berm fin is too large, a projectile may impact the fin before it has decelerated sufficiently to avoid ricocheting.

Disposed slightly forward of the lower end of the vertical floor rib 30 is a floor fin 48. The floor fin 48 acts in a similar manner as the berm fins and helps to prevent pieces of rubber from flowing to the bottom of the inclined surface 14.

The bullet backstop assembly 10, which is described in additional detail below, is a marked improvement over conventional bullet backstops. The design is modular to facilitate rapid installation and to permit disassembly without cutting up the bullet backstop, while providing strength and durability similar to that of the welded support structures of the prior art.

Figure 2A:
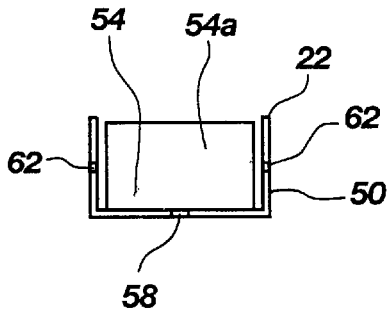
FIG. 2A shows a top view of a leg of the support structure of a bullet backstop assembly made in accordance with the principles of the present invention.

Turning now to FIG. 2A, there is shown a top view of a leg 22 of the support structure 18 of the bullet backstop assembly 10. The leg 22 includes a housing 50 which is generally U-shaped when viewed from the top. Inside of the U-shaped housing 50 is an L-shaped member 54. The L-shaped member forms a flange 54*a* at the bottom of the leg 22 for attachment to the floor if desired. In a presently preferred embodiment, the outer U-shaped housing 50 is approximately 3.25 inches wide and the L-shaped member 54 is substantially the same, except for the flange 54*a* which is slightly narrower.

Figure 2B:
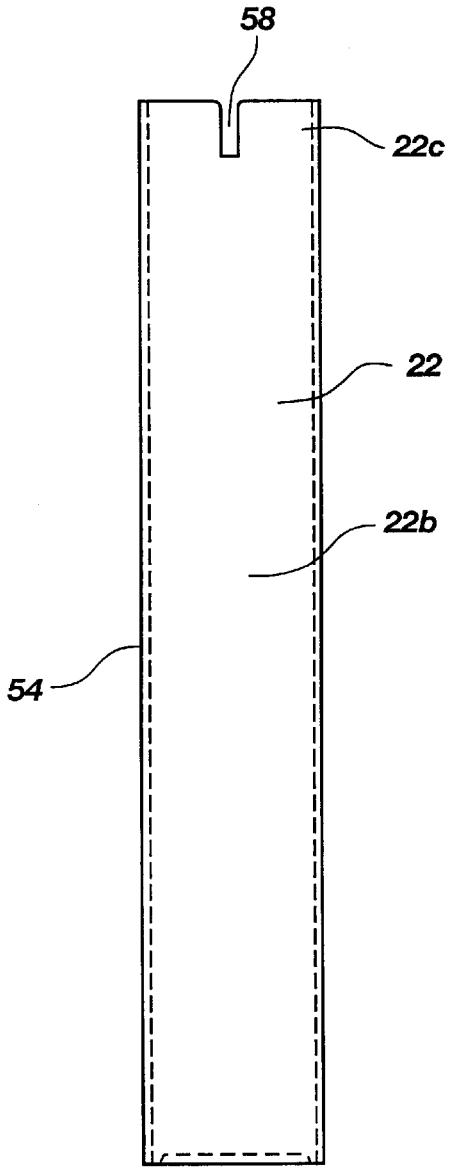
FIG. 2B shows a front view of the leg shown in FIG. 2A.

FIG. 2B shows a view of the front 22*b* of the leg 22 shown in FIG. 2A. Disposed in the upper end 22*c* of the leg 22 is a channel 58. The channel 58 extends generally vertically and is configured for receiving the ends of vertical ribs 26 (FIG. 1) in a manner which will be explained in detail below.

Figure 2C:
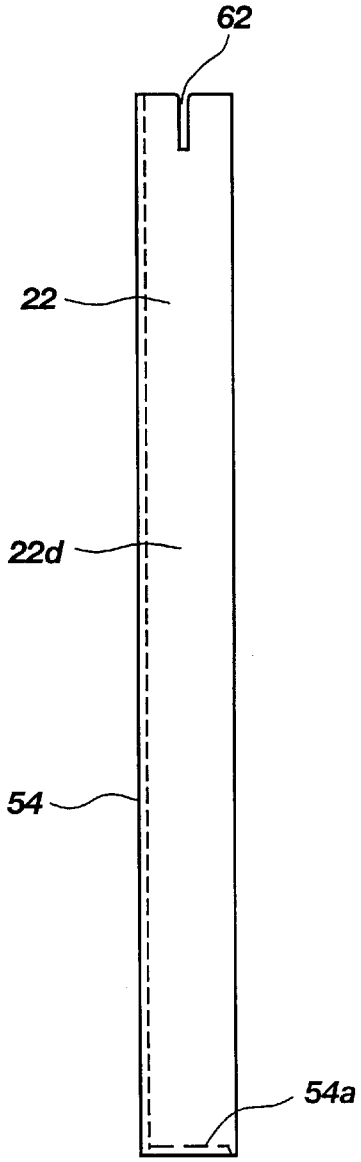
FIG. 2C shows a side view of the leg shown in FIGS. 2A and 2B.

FIG. 2C shows a view of a side 22d of the leg 22 shown in FIGS. 2A and 2B. As with the front 22*b*, each side 22*d* of the leg 22 has a channel 62 formed in the upper end 22*e*. As shown in FIG. 2A, both sides of the leg 22 have a channel 62. The channels 62 on each side 22*d* are disposed generally vertically and are formed for receiving an end of a horizontal rib (not shown) in a manner discussed in detail below. For reasons which will be explained below, the channels 62 in the sides 22*d* of the leg 22 are generally half the width of the channel 58 in the front 22*b*.

Figure 3A:
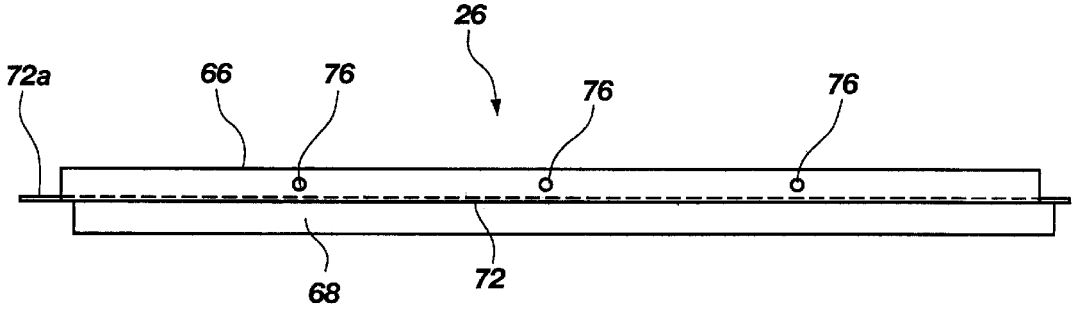
FIG. 3A shows a top view of a vertical rib of the support structure of a bullet backstop assembly made in accordance with the principles of the present invention.

Turning now to FIG. 3A, there is shown a top view of a vertical rib, generally indicated at 26. (It should be understood from the description contained herein that the vertical rib extends vertically at an angle such as 30 to 40 degrees. Thus, the use of the term vertical with respect thereto is not meant to suggest that it is disposed near 90 degrees relative to the horizon.)

The vertical rib 26 has an upper portion 66 and a lower portion 68 which are offset from each by a central portion 72 so that the rib has a generally S-shaped cross-section. Such a configuration provides the rib 26 with significant strength without wasting steel.

The upper portion 66 of the vertical rib 66 has a plurality of holes 76 formed therein through which the vertical rib 26 can be attached to the panels which form back wall plate/inclined surface 14 (FIG. 1). The lower portion 68 generally lacks the holes 76.

As shown in FIG. 3A, the upper portion 66 and the lower portion 68 are slightly offset from one another (i.e. each extends further on one end than the other). Because the vertical ribs 26 are disposed at an angle of between about 30 and 40 degrees from the legs 22, the offset allows the upper portion 66 and the lower portion 68 to properly engage the leg 22 and adjoining structures while an upper end 72*a* of the central portion 72 engages the channel 58 in the front 22*b* of the legs 22 in the manner described below.

Figure 3B:
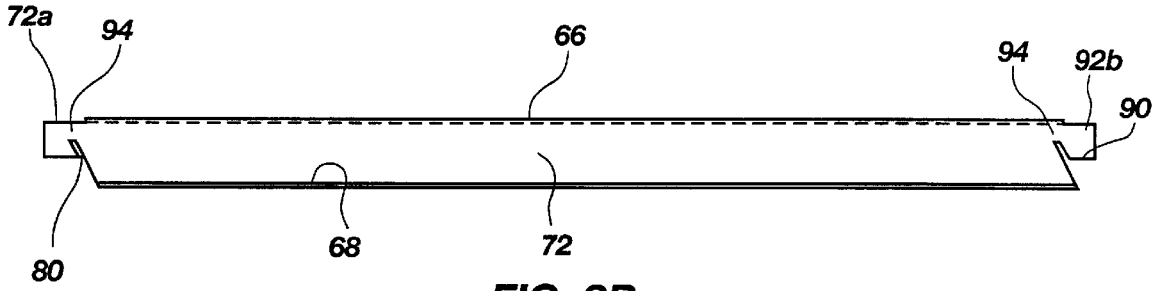
FIG. 3B shows a side view of the vertical rib of FIG. 3A.

FIG. 3B shows a side view of a vertical rib 26 with the central portion 72 being visible, upper portion 66 extending away from the viewer and the lower portion 68 extending toward the viewer. Disposed at either end of the vertical rib 26 is an end. As shown in FIG. 3B, the upper end 72*a* of the central portion has a channel 80 formed therein. The channel is disposed at an angle of between about 30 and 40 degrees so that when the vertical rib 26 is disposed at an angle of 30 to 40 degrees, the channel 80 is disposed generally vertically.

The upper end 72*a* of the central portion 72 has a thickness which is typically half the width of the channel 58 in the front 22*b* of the leg 22. The width of the channel 80 in the upper end 72*a*, in contrast, is substantially the same thickness as the portion of the front 22*b* of the leg 22 immediately below the channel 58. To attach the upper end 72*a* of the vertical rib 26 to the leg 22, the channels 80 and 50 are positioned in alignment. The vertical rib 26 is then lowered until the neck 84 of the vertical rib 26 is positioned between the walls defining the channel 58, and until the portion of the leg 22 immediately below the channel 58 is held between the walls defining the channel 80. Unless otherwise disturbed, the upper end 72*a* of the vertical rib 26 is held securely to the leg 22 by this tongue-in-groove configuration which provides a frictional force along the walls defining the channel 80.

The lower end 72*b* of the central portion 72 of the vertical rib 26 also has a channel 90 formed in the neck 94. The channel 90 in the lower end 72*b* is parallel to the channel 80 in the upper end 72*a* of the central portion 72, so that when the vertical rib 26 is disposed at an angle of 30 to 40 degrees, the channel 90 is generally vertical.

Like the upper end 72*a*, the lower end 72*b* slides into the channel 58 in the front 22*b* of the leg 22. When the upper end 72*a* of one vertical rib 26 and the lower end 72*b* of another vertical rib 26 are both placed in the channel 58, the necks of the vertical ribs are held between the walls defining the channel 58, and the portion of the leg 22 immediately below the channel is held between the walls defining the channels 80 and 90.

Figure 3C:
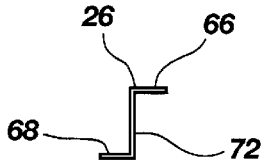
FIG. 3C shows an end view of the vertical rib of FIGS. 3A and 3B.

FIG. 3C shows an end view of the vertical rib 26 of FIGS. 3A and 3B. The end view shows the generally S-shaped configuration formed by the upper portion 66, the central portion 72 and the lower portion 68.

Figure 3D:
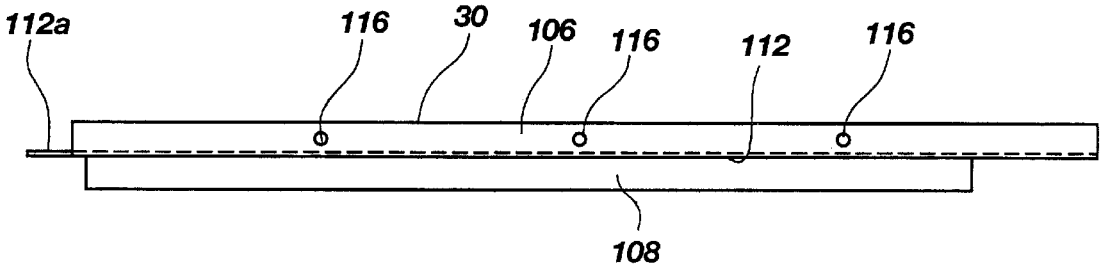
FIG. 3D shows a top view of a vertical floor rib of the support structure in accordance with the teachings of the present invention.
Figure 3E:
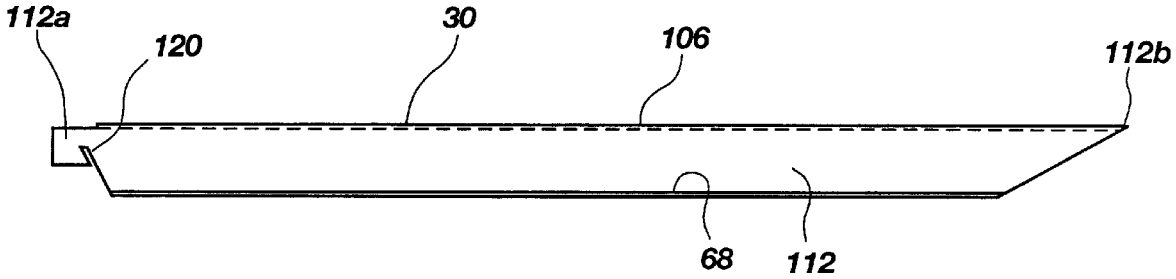
FIG. 3E shows a side view of the vertical floor rib of FIG. 3D.
Figure 3F:
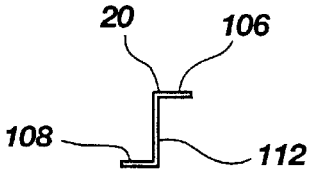
FIG. 3F shows an end view of the vertical floor rib of FIGS. 3D and 3E.

Turning now to FIGS. 3D thorugh 3F, there is shown a top view, a side view and an end view of a vertical floor rib 30. The vertical floor rib 30 is like the vertical rib 26 in that it has an upper portion 106 and a lower portion 108 which are separated by a central portion 112. The upper portion 106 has a plurality of holes 116 for attaching the vertical floor rib 30 to a plate which forms the inclined surface 14 (FIG. 1).

The vertical floor rib 30 also includes an upper end 112*a* with a channel 120 which is configured to be generally vertical when the vertical floor rib is disposed at an angle of between about 30 and 40 degrees. The opposing end 120*b* of the vertical floor rib 30, however, does not include an attachment mechanism. Rather, the lower end 120*b* of the vertical floor rib 30 is cut off at an angle of between about 50 and 60 degrees, so that when the vertical floor rib is inclined at 30 to 40 degrees, the lower end rests flat on a horizontal surface.

Figure 4A:
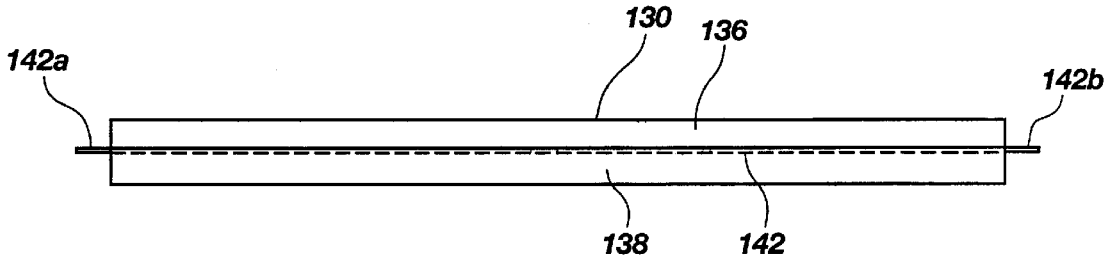
FIG. 4A shows a top view of a horizontal rib of the support structure of a bullet backstop assembly made in accordance with the principles of the present invention.
Figure 4B:
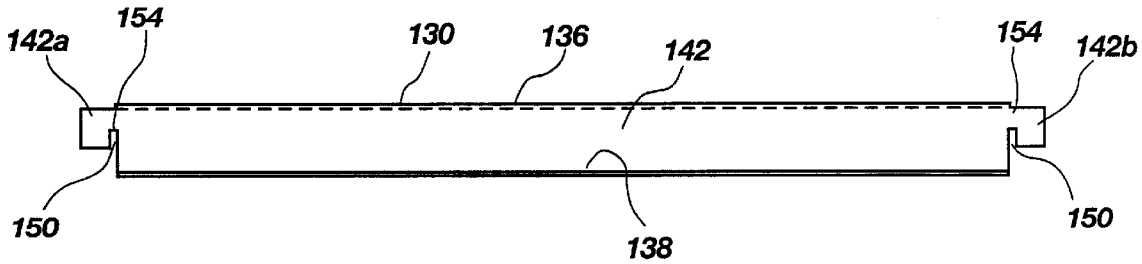
FIG. 4B shows a side view of the horizontal rib of FIG. 4A.
Figure 4C:
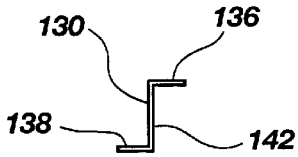
FIG. 4C shows an end view of the horizontal rib of FIGS. 4A and 4B.

Turning now to FIGS. 4A through 4C, there is shown a top view, a side view and an end view, respectively, of a horizontal rib 130. The horizontal rib 130 includes an upper portion 136 and a lower portion 138 which are separated by a central portion 142 so as to form a generally S-shaped beam.

The central portion 142 has a first end 142*a* and a second end 142*b*. Both of the first and second ends 142*a* and 142*b* have a generally vertical channel 150 formed therein to leave a neck 154. The channel 150 is preferably of the same width as the thickness of the sides 22*d* of the leg 22.

In use, the channel 150 at one end (either 142*a* or 142*b*) of the horizontal rib is placed in alignment with the channel 62 in the side 22*d* of the leg 22. As the horizontal rib 130 is lowered, the walls defining the channel 150 on the end of the horizontal rib 130 engage the side 22*d* of the leg 22 below the channel 62, and the walls defining the channel 62 engage the neck 154 above the channel 150. Thus, the horizontal ribs 130 extend horizontally between legs 22 to provide lateral support to the legs, while the vertical ribs 26 connect the legs at an angle to form a support for the inclined surface 14 (FIG. 1).

Figure 5A:
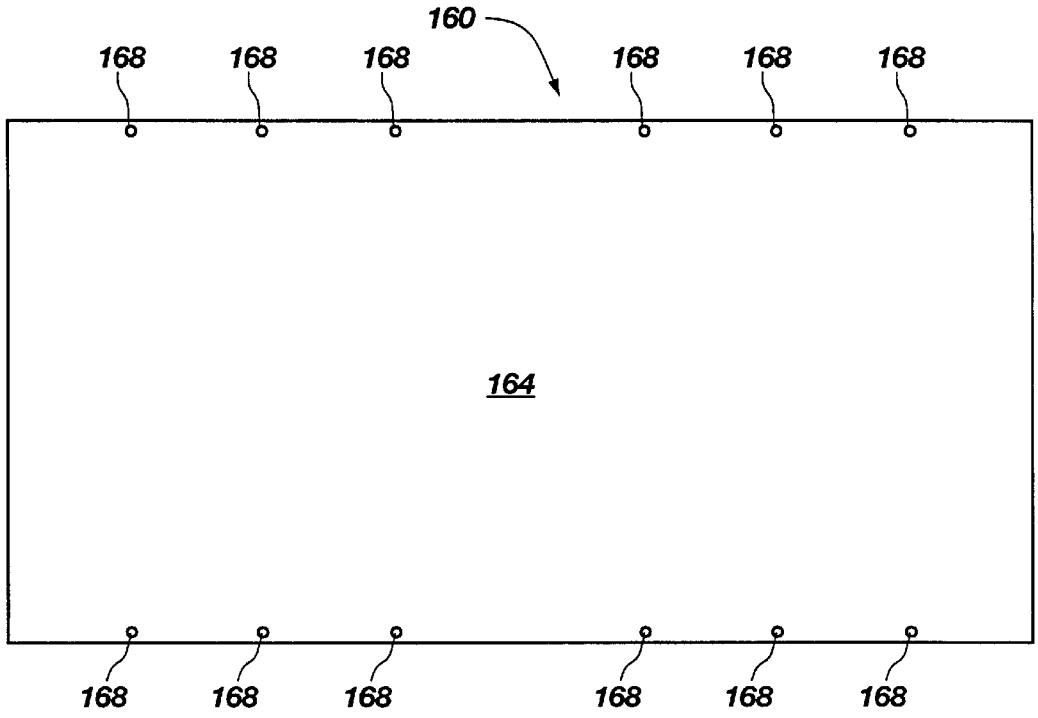
FIG. 5A shows a top view of a back panel which is used to form the back wall plate defining the inclined surface.

Turning now to FIG. 5A, there is shown a top view of a panel, generally indicated at 160, which is used to form the back wall plate defining the inclined surface. The panel 160, is typically formed by a piece of panel steel 164 which is 4 ft×4 ft and approximately ¼ inch thick. Along two or more of the sides of the panel 160 are a plurality of holes 168 which are positioned to be in alignment with the holes 76 in the upper portion 66 of the vertical ribs 26. As will be explained in additional detail below, the holes 168 enable the panel 160 to be releasably bolted to the vertical rib 26. This enables the bullet backstop assembly 10 to be assembled and disassembled without welding or cutting.

Figure 5B:
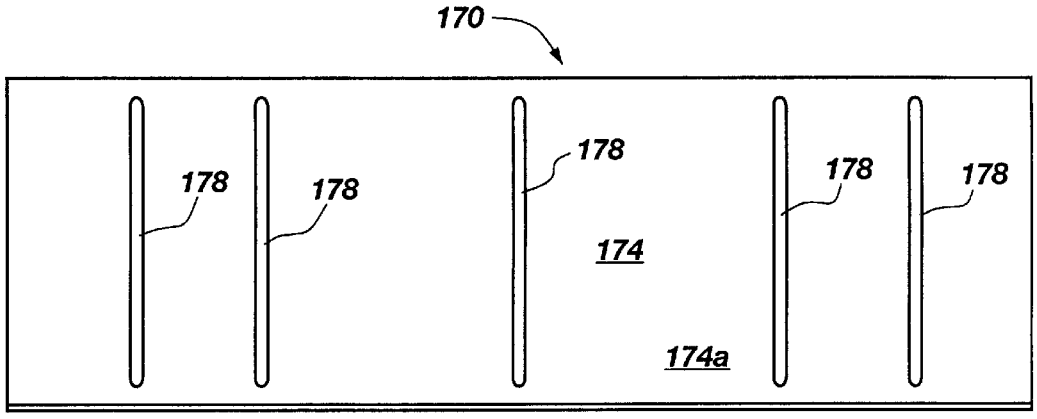
FIG. 5B shows a top view of an extender panel which is also used to form part of the back wall plate defining the inclined surface.
Figure 5C:
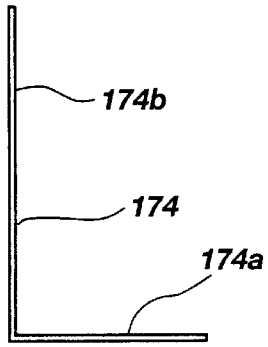
FIG. 5C shows an end view of the extender panel of FIG. 5B.

FIG. 5B shows a top view of an extender panel, generally indicated at 170, and FIG. 5C shows an end view of the extender panel. The extender panel 170 preferably is formed of an L-shaped steel plate 174. The extender panel 170 has a plurality of slots 178 formed on two lateral sides. The slots 178 receive the bolts used to connect the vertical ribs 26 to the panel 160. Because of the elongate nature of the slots 178, the extender panel 170 can extend outwardly from the last vertical rib 26 a desired distance. Thus, the extender panel 178 can be used to extend the inclined surface on either side into engagement with a sidewall of the shooting range.

The L-shaped configuration also allows the extender panel 170 to serve as a sidewall. When the base portion 174*a* of the extender panel 170 is attached to the back panel 164, the side portion 174*b* extends upwardly to contain the bullet deceleration material.

Figure 6A:
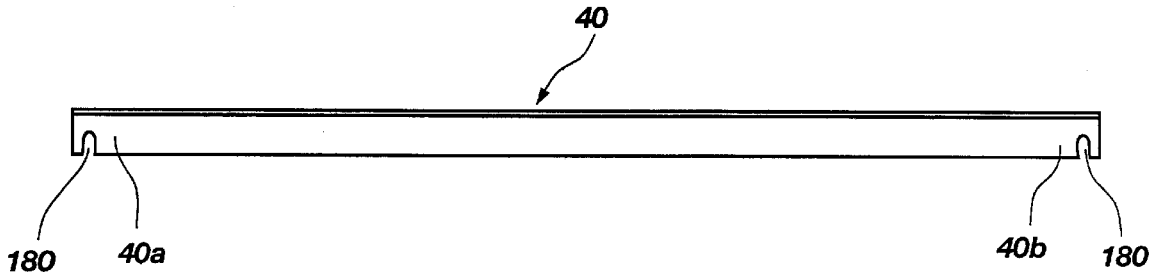
FIG. 6A shows a top view of a berm fin made in accordance with the principles of the present invention.
Figure 6B:
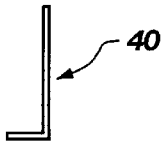
FIG. 6B shows an end view of the berm fin of FIG. 6A.

FIGS. 6A and 6*b* show a top view and an end view of a berm fin generally indicated at 40 made in accordance with the principles of the present invention. The berm fin 40 is L-shaped and is typically formed from a piece of steel. At each end 40*a* and 40*b*, the berm fin 40 has a channel 180 configured to receive a bolt. As will be discussed below in additional detail, the bolts used to secure the vertical ribs 26 and the back panels 160 slide into the channel 180 to hold the berm fin 40 in place on the inclined surface 14.

The floor fin 48 (FIG. 1) has the same general shape as the berm fin 44. However, to provide additional support to the deceleration material 44, the floor fin 48 may be approximately twice as high.

Figure 7A:
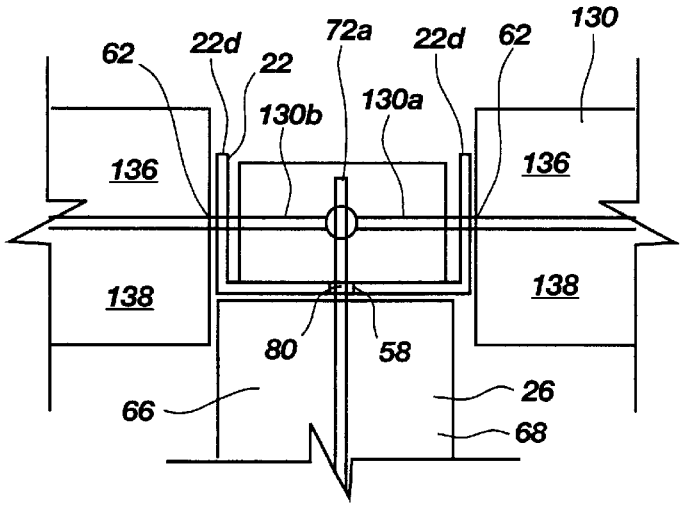
FIG. 7A shows a top view of a vertical rib and a pair of horizontal ribs engaging a leg in accordance with the principles of the present invention.

Turning now to FIG. 7A, there is shown a top, fragmented view of a vertical rib 26 and a pair of horizontal ribs 130 engaging a leg 22 in accordance with the principles of the present invention. Each horizontal rib 130 has an end (142*a* and 142*b*, respectively) which is nested in the channel 62 in the sides 22*d* of the leg 22 and which extends into the center of the leg. With the horizontal ribs 130 in place the leg 22 is braced against lateral movement.

The vertical rib 26 also has an upper end 72*a* which is nested in the channel 58, and a portion of the front 22*b* of the leg 22 is nested in the channel 80 in the upper end.

As will be appreciated, because the ribs 26 and 130 snap or slide in place, the ribs can be attached to the leg 22 in a matter of seconds. With the ribs 26 and 130 attached, the leg is held securely in place.

Figure 7B:
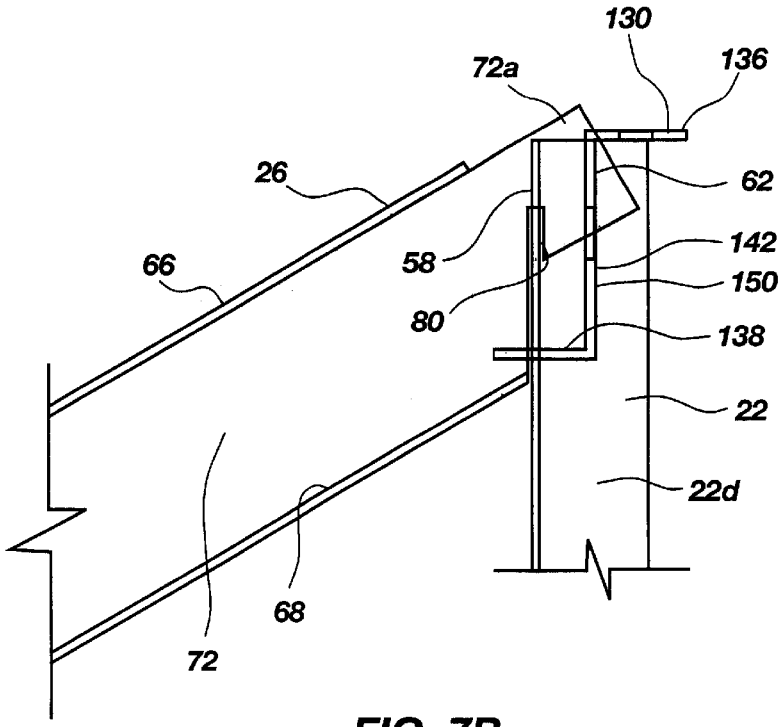
FIG. 7B shows a side view of the configuration shown in FIG. 7A.

FIG. 7B shows a side view of the leg 22 and the ribs 26 and 130 configured as in FIG. 7A and with the structures numbered accordingly. Such a configuration would typically only be used at the upper most end of the support structure 18 used to hold the inclined surface 14 (FIG. 1).

Figure 8A:
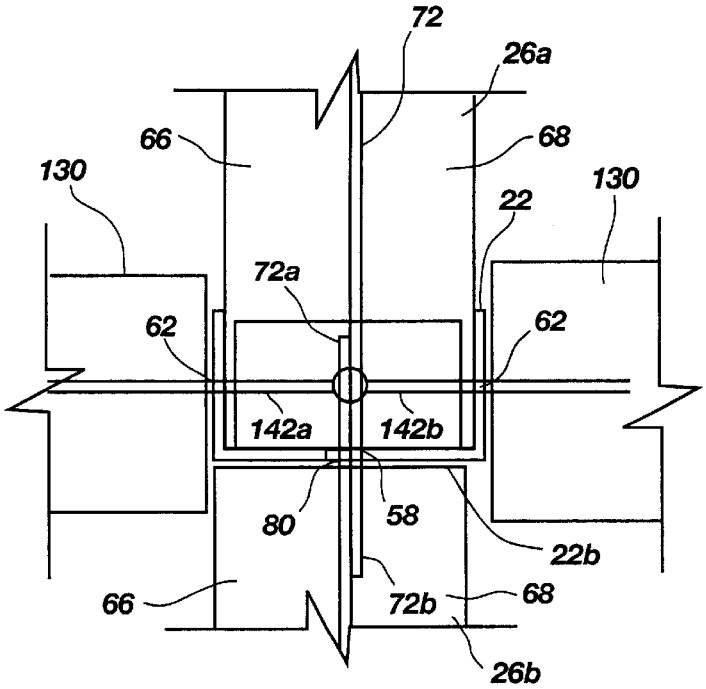
FIG. 8A shows a top view of a pair of vertical ribs and a pair of horizontal ribs engaging a leg in accordance with another aspect of the present invention.

Turning to FIG. 8A, there is shown a top view of a pair of vertical ribs 26 and a pair of horizontal ribs 130 engaging a leg 22 in accordance with one aspect of the present invention. The ends 142*a* and 142*b* of the horizontal ribs 130 are positioned in the channels 62 on the sides 22*d* of the leg 22, and preferably with the sides 22*d* of the leg extending into the channel 150 in the ends. This overlapping arrangement prevents the leg 22 from sliding with respect to the horizontal ribs 130 and vice-versa.

Unlike the horizontal ribs 130, both the lower end 72*b* of upper rib 26*a* and the upper end 72*a* of the lower rib 26*b* nest in the channel 58 in the front 22*b* of the leg 22. Preferably, the portion of the front 22*b* of the leg 22 immediately below the channel 58 nests in the channel 80 of the lower vertical rib 26*b* and the channel 90 of the upper vertical rib 26*a* to securely hold the leg and the overlapping ends 72*a* and 72*b*.

Figure 8B:
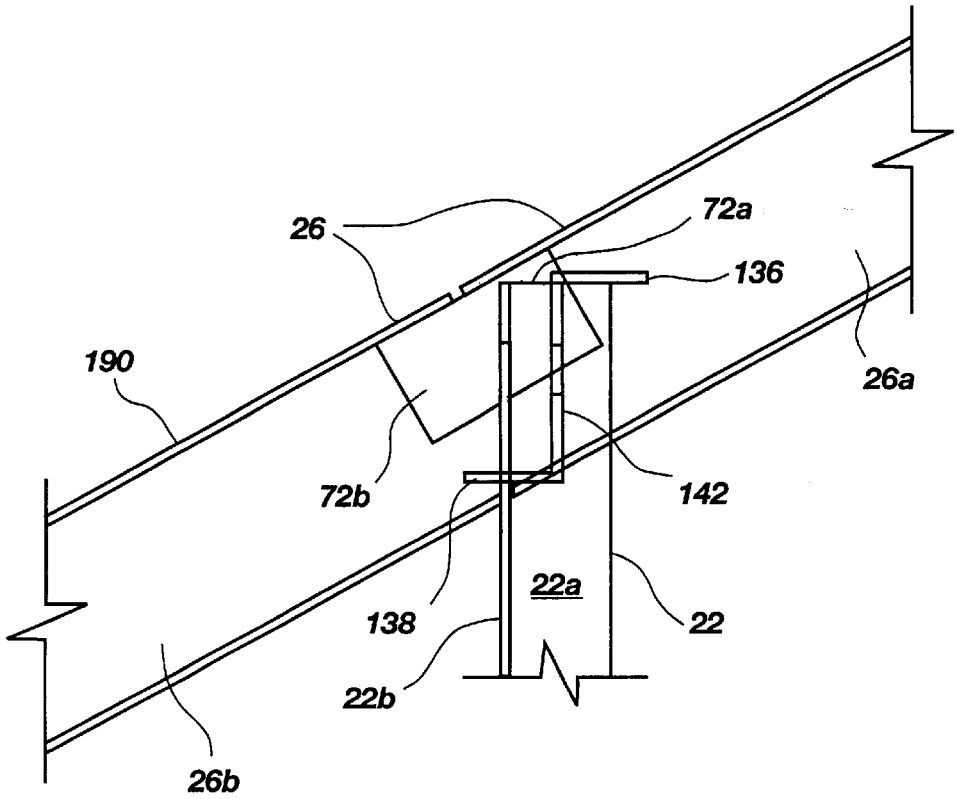
FIG. 8B shows a side view of the configuration shown in FIG. 8A.

With the lower end 72*b* of the upper vertical rib 26*a* and the upper end 72*a* of the lower vertical rib 26*b* mounted in the channel 58, the two vertical ribs form a substantially continuous beam 190, as shown in FIG. 8B. The substantially continuous beam 190 is disposed at an angle of between about 30 to 40 degrees so that when a plurality of back panels are attached to the beam they form an inclined surface onto which bullet deceleration media is piled to form a berm trap.

Figure 9A:
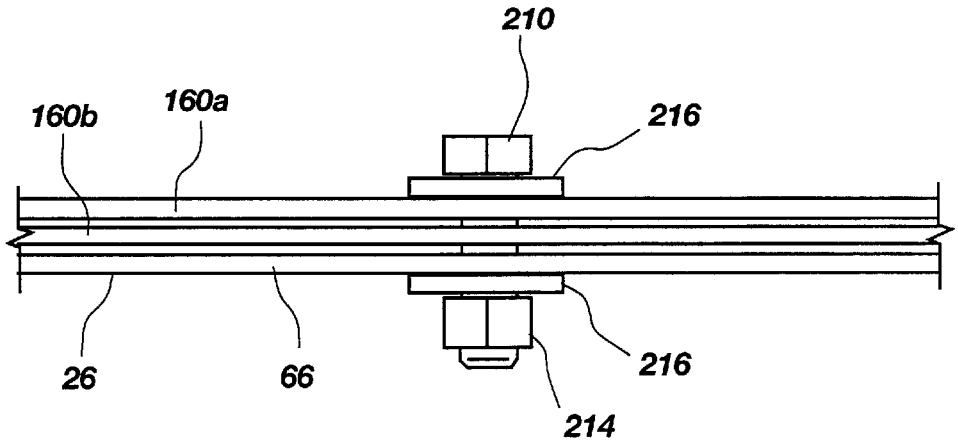
FIG. 9A shows a side view of a pair of back panels and a vertical rib being joined together in accordance with the principles of the present invention.
Figure 9B:
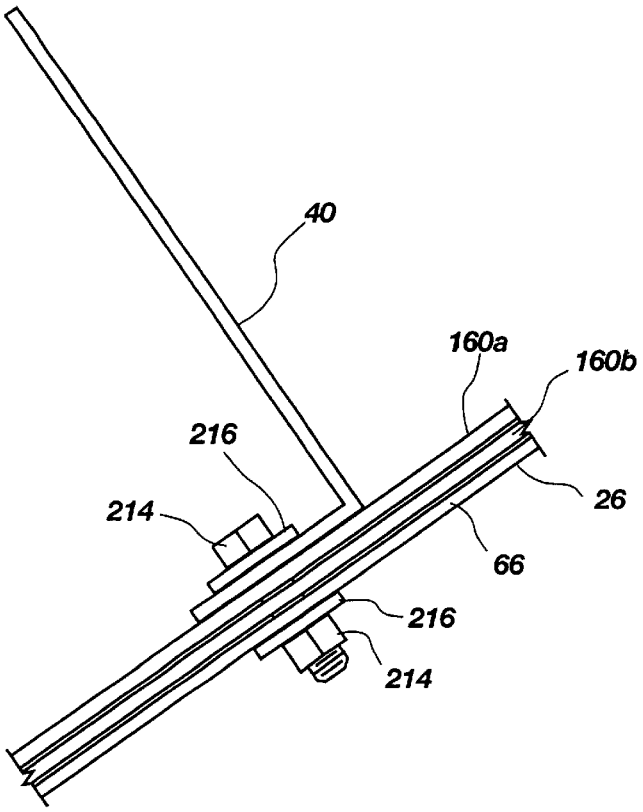
FIG. 9B shows a side view of a pair of back panels, a vertical rib and a berm fin being attached to one another in accordance with one aspect of the present invention.

Turning now to FIG. 9A, there is shown a side view of a pair of back panels 160*a* and 160*b* and the upper portion 66 of a vertical rib 26 being joined together in accordance with the principles of the present invention. Preferably, the back panels 160*a* and 160*b* are overlapped. A bolt is then extended through the holes 168 along the sides, so that the bolt attaches both back panels to a single vertical rib 26. By having the back panels in an overlapping configuration, the chances of a projectile passing through the seams of the panels is minimal, even if little deceleration were provided by the deceleration medium.

In normal assembly, the back panel 160 in one corner of the bullet backstop assembly 10 will be mounted in place. The remaining back panels are then laid out on the support structure 18 until an entire row has been completed. As each back panel 160 is laid in place, the bolts 210 are inserted through the holes 168 in the back panel (FIG. 5A) and the channels 178 in the extender panels 170 (FIG. 5B).

Once the back panels 160 are in their proper configuration, a nut 214 is tightened on the bolt 210 to secure the back panels 160*a* and 160*b* to the vertical rib 26. Washers 216 may also be used to improve the hold on the back panels 160*a* and 160*b* and the vertical rib 26.

While the attachment configuration shown in FIG. 9A is common, it is also desirable to have berm fins 40 mounted on the inclined surface 14 as shown in FIG. 1. The berm fins 40 help stabilize the deceleration medium and keep it from flowing down the inclined surface 14 as it is struck repeatedly by projectiles. By simply nesting the bolt 210 into the slot 180 (FIG. 6A) in the end 40*a* or 40*b* of the berm fin 40, the berm fin can be held to the back panels 160*a* and 160*b* forming the inclined surface. Tightening the bolt 210 and nut 214 securely holds the berm fin 40 in place with no welding or other time consuming attachment procedures required.

Figure 10:
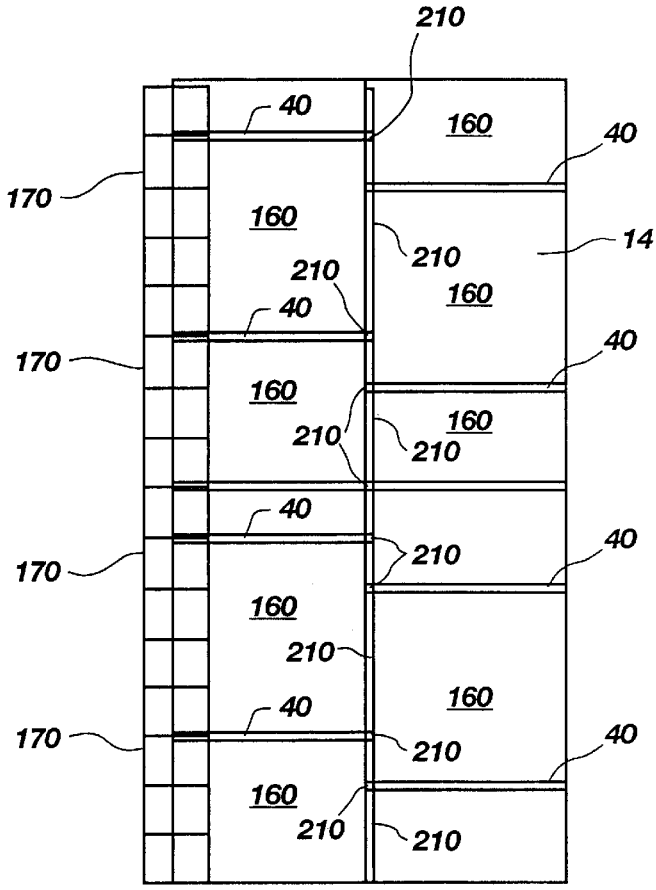
FIG. 10 shows a top view of a plurality of back panels and berm fins attached together to form a back wall plate defining an inclined surface for holding a bullet deceleration material.

FIG. 10 shows a top view of a plurality of back panels 160, extender panels 170 and berm fins 40 attached together by bolts 210 to form a portion of a back wall plate defining an inclined surface 14 for holding a bullet deceleration material. By selecting the appropriate number of columns of back panels 160 and adjusting the outward extension of the extender panels 170, the bullet backstop assembly can be configured to virtually any desired width. Furthermore, because there is a relatively small number of pieces and all pieces can fit through a common door opening, there is no need to take detailed measurements prior to manufacturing the parts for the bullet backstop assembly 10. Finally, because the a parts are modular, both shipping and installation costs are reduced.

Thus, there is disposed an improved bullet backstop assembly. In light of the present disclosure, those skilled in the art will appreciate numerous modifications which can be made without departing from the scope and spirit of the invention. The appended claims are intended to cover such modifications.

What is claimed is:

1. A bullet back stop assembly comprising:

a plurality of back panels configured for attachment to one other to form a continuous back plate forming a generally bullet proof inclined surface; and a support structure removably attached to the inclined surface, the support structure comprising a plurality of legs, a plurality of generally vertical ribs removably attached to the legs and to the back panels forming the inclined surface, and a plurality of horizontal ribs removably attached to the legs so as to provide lateral support to the legs, wherein at least two of the generally vertical ribs have ends which overlap when the at least two vertical ribs are attached to a common leg.

2. The bullet backstop assembly of claim 1, wherein the plurality of back panels are releasably attached to the plurality of vertical ribs.

3. The bullet backstop assembly of claim 2, wherein each of the plurality of vertical ribs has a plurality of holes formed therein, and wherein the back panels have holes formed therein for receiving an attachment means through the holes to secure the plurality of vertical ribs to the plurality of back panels.

4. The bullet backstop assembly of claim 1, wherein each vertical rib has at least one end configured for tool-less attachment to a leg.

5. The bullet backstop assembly of claim 4, wherein at least one end of each vertical rib forms a tongue-in-groove engagement with the leg.

6. The bullet backstop assembly of claim 1, wherein the ends of the plurality of vertical ribs nest in a channel in the leg.

7. The bullet backstop assembly of claim 1, wherein each of the vertical ribs of the plurality of vertical ribs has an upper portion and a lower portion offset by a central portion to form a generally S-shaped rib.

8. The bullet backstop assembly of claim 1, wherein the plurality of horizontal ribs each have at least one end configured for tool-less attachment to the legs.

9. The bullet backstop assembly of claim 8, wherein the at least one end of each of the plurality of ribs forms a tongue-in-groove engagement with the legs.

10. The bullet backstop assembly of claim 1, wherein two adjacent back panels of the plurality of back panels are attached to a vertical rib such that the back panels are in overlapping engagement with one another.

11. The bullet backstop assembly of claim 1, further comprising at least one berm fin releaseably attached to the back panel.

12. The bullet backstop assembly of claim 11, wherein the berm fin comprises a channel for receiving an attachment mechanism secured to a vertical rib.

13. The bullet backstop assembly of claim 1, further comprising bullet deceleration medium disposed on the inclined surface for decelerating projectiles.

14. The bullet backstop assembly of claim 1, wherein the ends of the plurality of vertical ribs nest in a channel in the leg.

15. The bullet backstop assembly of claim 1, further comprising bullet deceleration medium disposed on the inclined surface for decelerating projectiles.

16. A bullet back stop assembly comprising:

a plurality of back panels configured for attachment to one other to form a continuous back plate forming an inclined surface; and a support structure removably attached to the inclined surface, the support structure comprising a plurality of legs, a plurality of vertical ribs attached to the legs, and a plurality of horizontal ribs attached to the legs so as to provide lateral support to the legs, the assembly further comprising at least one extender panel, the extender panel being slidably connected to at least one back panel.

17. The bullet backstop assembly of claim 16, wherein the at least one extender panel comprises a channel for receiving an attachment mechanism secured to a vertical rib.

18. The bullet backstop assembly of claim 16, wherein the extender panel is L-shaped.

19. A bullet back stop assembly comprising:

a plurality of back panels formed of a bullet resistant material and configured for attachment to one another to form a continuous back plate forming an inclined surface; and a support structure removably attached to the inclined surface, the support structure comprising a plurality of legs and a plurality of support ribs removably attached to the legs for supporting the inclined surface, the support ribs being attached in a tool-less engagement, the plurality of support ribs comprising a plurality of vertical ribs and a plurality of horizontal ribs, and wherein at least two of the vertical ribs have ends which overlap when the at least two vertical ribs are attached to a common leg.

20. The bullet backstop assembly of claim 19, wherein the plurality of back panels are releasably attached to the plurality of vertical ribs.

21. The bullet backstop assembly of claim 19, wherein each of the plurality of vertical ribs has a plurality of holes formed therein, and wherein the back panels have holes formed therein for receiving an attachment means through the holes to secure the plurality of vertical ribs to the plurality of back panels.

22. The bullet backstop assembly of claim 19, wherein a plurality of the vertical ribs each have at least one end configured for tool-less attachment to a leg.

23. The bullet backstop assembly of claim 22, wherein at least one end of one of the plurality of vertical ribs forms a tongue-in-groove engagement with the leg.

24. A bullet back stop assembly comprising:

a plurality of back panels configured for attachment to one other to form a continuous back plate forming an inclined surface;

an extender panel slidably connected to at least one back panel; and a support structure removably attached to the inclined surface, the support structure comprising a plurality of legs, a plurality of vertical ribs attached to the legs, and a plurality of horizontal ribs attached to the legs so as to provide lateral support to the legs.

* * * * *